US008591272B2

(12) United States Patent
Shiratori et al.

(10) Patent No.: US 8,591,272 B2
(45) Date of Patent: Nov. 26, 2013

(54) LEAD FRAME, METHOD OF MANUFACTURING A CONTACT GROUP, AND CONNECTOR

(75) Inventors: Masayuki Shiratori, Tokyo (JP); Shuichi Aihara, Tokyo (JP); Masayuki Katayanagi, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/537,504

(22) Filed: Jun. 29, 2012

(65) Prior Publication Data

US 2013/0090022 A1 Apr. 11, 2013

(30) Foreign Application Priority Data

Oct. 11, 2011 (JP) ..... 2011-224033

(51) Int. Cl.
*H01R 9/24* (2006.01)

(52) U.S. Cl.
USPC ..... 439/885; 29/884

(58) Field of Classification Search
USPC ..... 439/885; 29/884
See application file for complete search history.

(56) References Cited

U.S. PATENT DOCUMENTS

| | | | | |
|---|---|---|---|---|
| 4,292,736 | A * | 10/1981 | Hughes et al. | 29/884 |
| 6,196,886 | B1 * | 3/2001 | Sato | 439/885 |
| 7,448,884 | B2 | 11/2008 | Kato et al. | |
| 2011/0171859 | A1 * | 7/2011 | Fjelstad | 439/862 |

FOREIGN PATENT DOCUMENTS

| | | |
|---|---|---|
| JP | 2008-041656 | 2/2008 |

* cited by examiner

*Primary Examiner* — Tho D Ta
(74) *Attorney, Agent, or Firm* — Collard & Roe, P.C.

(57) ABSTRACT

By using a lead frame as an intermediate member, a contact group of a connector is manufactured. The lead frame includes a plurality of first leads arranged on a plane and spaced from one another, a plurality of pairs of second leads, each pair being arranged on the plane between the first leads, and a connecting portion connecting the first and the second leads on one end side. The second leads have a pitch which is greater on the other end side than that on the one end side to make the second leads approach the first leads on the other end side, respectively. The lead frame further includes bridge portions connecting approached ones of the first and the second leads to each other at a portion where an interval between the first and the second leads is reduced.

10 Claims, 6 Drawing Sheets

LEAD FRAME, METHOD OF MANUFACTURING A CONTACT GROUP, AND CONNECTOR

This application is based upon and claims the benefit of priority from Japanese Patent Application No. 2011-224033, filed Oct. 11, 2011, the disclosure of which is incorporated herein in its entirety by reference.

TECHNICAL FIELD

This invention relates to a connector and, in particular, to a lead frame as an intermediate member for forming a contact group of the connector, and a method of manufacturing the contact using the lead frame.

BACKGROUND ART

There is known a differential transmission system adapted to transmit a differential signal pair, comprising signals having opposite phases, in two signal lines forming a pair. Since the differential transmission system has a feature that a high data transfer rate can be achieved, it has recently been put to practical use in various fields.

For example, in the case of using the differential transmission system for data transfer between a device and a liquid crystal display, the device and the liquid crystal display are each provided with a display port connector which is designed according to the display port standard. As this display port standard, VESA DisplayPort Standard Version 1.0 or its Version 1.1a is known.

This display port connector is a kind of differential signal connector and has a first connection side for connection to a connection partner and a second connection side for connection to a board of the device or the liquid crystal display. The configuration of the first connection side is strictly defined by the display port standard in terms of the relationship with the connection partner while the configuration of the second connection side is relatively free. This type of differential signal connector is disclosed in Patent Document 1 (Japanese Patent No. 4439540 (JP-A-2008-41656)) and has a housing and a contact group held by the housing.

As illustrated in FIG. 1, the contact group comprises three ground contacts 1 spaced from one another and two pairs of signal contacts 2. The signal contacts 2 of each pair are disposed between two adjacent ones of the ground contacts 1. Each of the ground contacts 1 has one end 1*a* and the other end 1*b* and each of the signal contacts 2 has one end 2*a* and the other end 2*b*. On the first connection side of the connector, the one ends 1*a* of the ground contacts 1 and the one ends 2*a* of the signal contacts 2 are adjacently arranged along a single straight line. The ground contacts 1 and the signal contacts 2 extend from the first connection side towards the second connection side in parallel to one another and then are perpendicularly bent in the same direction at positions offset from each other. Thus, on the second connection side of the connector, the other ends 1*b* of the ground contacts 1 are located at both ends of a long side of a trapezoid while the other ends 2*b* of the signal contacts 2 are located at both ends of a short side of the trapezoid. The other ends 1*b* of the ground contacts 1 and the other ends 2*b* of the signal contacts 2 are inserted into through holes of a connection object (such as a board) and connected to the connection object by soldering.

In the above-mentioned contact group, the other ends 1*b* of the ground contacts 1 and the other ends 2*b* of the signal contacts 2 are arranged in different rows on the second connection side. It is therefore readily possible to widen a distance or interval between the other ends 1*b* of the ground contacts 1 and the other ends 2*b* of the signal contacts 2 within a limited space or distance.

SUMMARY OF THE INVENTION

However, when the contact group is reduced in pitch, the other ends of the signal contacts in each pair approach each other on the second connection side of the connector. In this event, it is assumed that connection of the contact group to the connection object is not easy. For example, it may be difficult to form the through holes in the connection object or to solder the other ends of the signal contacts to the connection object. Therefore, the technique disclosed in Patent Document 1 is not sufficient to meet the demand for reduction in pitch of the contact group.

When the above-mentioned contact group is manufactured, it is advantageous in terms of productivity to collectively manufacture a whole of the group rather than manufacturing the contacts one by one. In order to collectively manufacture a whole of the group, a metal plate is subjected to pressing to punch out an intermediate member having a number of leads extending from a connecting portion in the same direction. Herein, the intermediate member of the type will be called a lead frame. However, in manufacture of the lead frame, a burden is placed on a design of a die in a case where when a punching width for pressing work known in the art is not sufficiently wide or is minimum. Therefore, it is inevitable to manufacture the individual contacts one by one and then assemble the contacts into the contact group. Thus, manufacture is not easy.

It is therefore an exemplary object of this invention to provide a connector which can be reduced in pitch of a contact group and which can easily be manufactured.

Other objects of the present invention will become clear as the description proceeds.

According to a first exemplary aspect of the present invention, there is provided a lead frame for use as an intermediate member for manufacturing a contact group of a connector, comprising a plurality of first leads arranged on a plane and spaced from one another, a plurality of pairs of second leads, each pair being arranged on the plane between the first leads, and a connecting portion connecting the first and the second leads on one end side, wherein the second leads have a pitch which is greater on the other end side than that on the one end side to make the second leads approach the first leads on the other end side, respectively, and wherein the lead frame further comprises bridge portions connecting approached ones of the first and the second leads to each other at a portion where an interval between the first and the second leads is reduced.

According to a second exemplary aspect of the present invention, there is provided a method of manufacturing a contact group, comprising preparing the lead frame according to the first exemplary aspect, cutting the bridge portions of the lead frame by shearing, and bending the first and the second leads in a direction intersecting the plane.

According to a third exemplary aspect of the present invention, there is provided a contact group manufactured by using as an intermediate member the lead frame according to the first exemplary aspect.

According to another exemplary aspect of the present invention, there is provided a connector comprising a contact group using as an intermediate member the lead frame according to the first exemplary aspect, wherein the first and the second leads being bent at positions different from each other in a direction intersecting the plane simultaneously when or after the bridge portions is cut by shearing, the connecting portion being cut away from the first and the second leads.

DESCRIPTION OF THE EMBODIMENT

Referring to FIGS. 2A to 2D, a connector according to an embodiment of this invention will be described.

The connector 10 illustrated in FIGS. 2A to 2D is a 20-pin differential signal connector having a plurality of contacts in upper and lower two rows and is mounted on a printed board 11 when it is used. The differential signal connector 10 is connected on a front side to a mating connector (not shown) as a connection partner and is connected to the printed board 11 on a bottom side. Herein, the front side for connection to the mating connector is called a first connection side while the bottom side for connection to the printed board 11 is called a second connection side. On the first connection side, the differential signal connector 10 has a fitting projection 12 adapted to fit to the mating connector and having a shape extending laterally in parallel to a connector fitting plane. The second connection side will later be described in detail.

Figure 1:
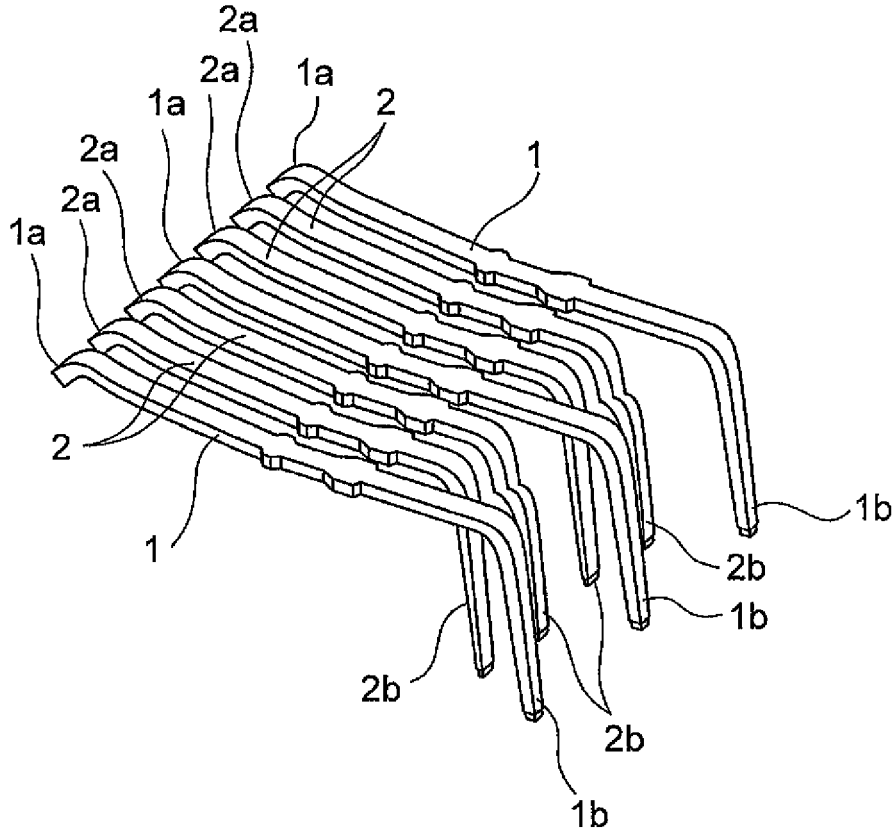
FIG. 1 PRIOR ART
FIG. 1 is a perspective view for describing a contact group disclosed in Patent Document 1 (JP-A-2008-41656)
Figure 2A:
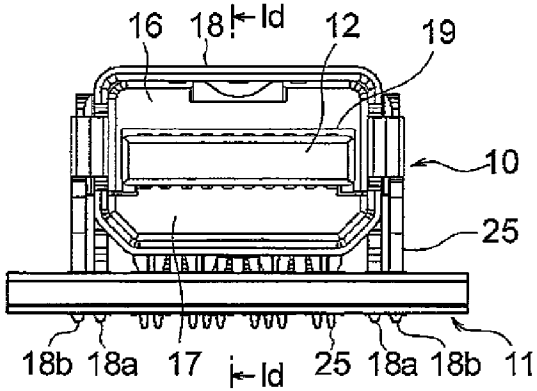
FIG. 2A is a front view of a connector according to one embodiment of this invention when the connector is mounted to a board.
Figure 2B:
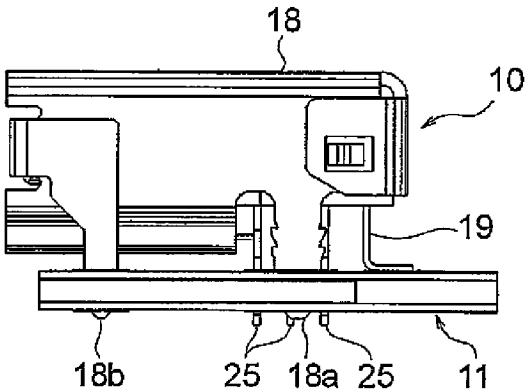
FIG. 2B is a right side view of the connector illustrated in FIG. 2A.
Figure 2C:
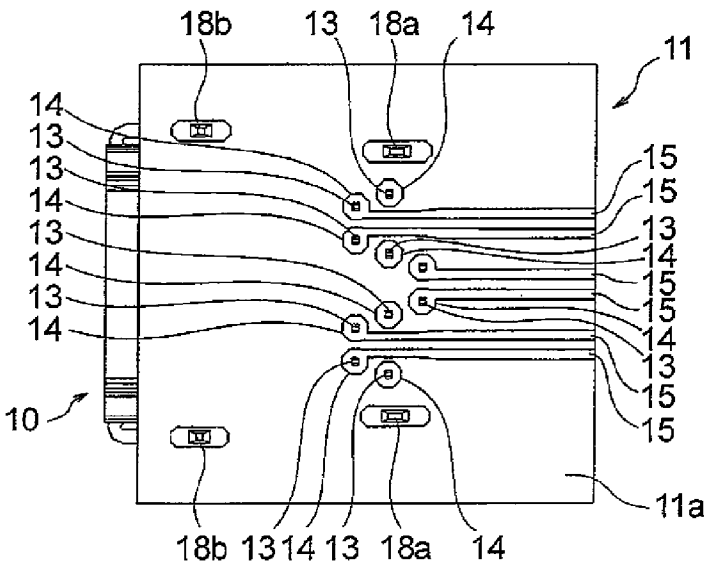
FIG. 2C is a bottom view of the connector illustrated in FIG. 2A.
Figure 2D:
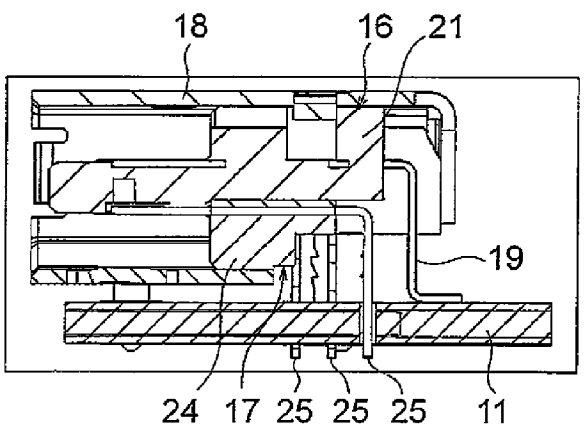
FIG. 2D is a sectional view taken along a line Id-Id in FIG. 1A.

The printed board 11 used herein is a multilayer board. The printed board 11 is provided with a number of through holes 13 as seen from FIG. 2C showing a lower surface 11*a* of the printed board 11. The printed board 11 has a plurality of lands 14 each of which is in the form of a doughnut-shaped conductor pattern and each of which is formed around an opening of each of the through holes 13. From some of the lands 14, wiring patterns 15 are drawn out in parallel along the board 11. Positions and roles of the through holes 13 will be clarified later.

The differential signal connector 10 comprises an upper contact assembly 16, a lower contact assembly 17, and a conductive connector shell 18 surrounding the upper and the lower contact assemblies 16 and 17 as a whole. The upper contact assembly 16 comprises a number of conductive upper contacts 19, called additional contacts herein, and an insulating upper housing 21 holding the upper contacts 19. The upper contacts 19 have forward ends arranged in an upper part of the fitting projection 12, then extend rearward, and then are perpendicularly bent downward so that lower ends of the upper contacts 19 are soldered to wiring patterns on an upper surface (not illustrated) of the printed board 11 in an SMT structure. The connector shell 18 has a plurality of fixing legs 18*a* and 18*b* adapted to be fixed to the printed board 11. By engagement of the fixing legs 18*a* and 18*b* with the printed board 11, the differential signal connector 10 is firmly fixed to the printed board 11. The lower contact assembly 17 will later be described in detail.

Next, referring to FIGS. 3A to 3D in addition to FIGS. 2A to 2D, the lower contact assembly 17 will be described in detail.

The lower contact assembly 17 comprises three pairs of conductive signal contacts 22, four conductive ground contacts 23, and an insulating lower housing 24 holding the signal contacts 22 and the ground contacts 23. On the first connection side of the lower housing 24, a contact array of a fixed pitch (preferably 0.7 mm or less) extends in a first direction A1. In the contact array, the ground contacts 23 are arranged on both sides of each pair of signal contacts 22.

All of the signal contacts 22 and the ground contacts 23 extend rearward in a second direction A2 perpendicular to the first direction A1 to pass through the lower housing 24 and then are perpendicularly bent towards the second connection side to extend downward in a third direction A3 perpendicular to the first and the second directions A1 and A2. In the following description, the signal contacts 22 and the ground contacts 23 may be collectively called lower contacts 25.

As seen from FIGS. 2A to 2D, on the first connection side of the differential signal connector 10, the lower contacts 25 are arranged in a lower part of the fitting projection 12 so as to face the upper contacts 19 at a distance therefrom. As a consequence, the mating connector is brought into contact with the upper contacts 19 and the lower contacts 25 when it is fitted to the fitting projection 12, so that the mating connector is electrically connected to the differential signal connector 10. Herein, a portion, which is brought into contact with the mating connector, of each lower contact 25 is called a connector contacting portion.

On the other hand, on the second connection side of the differential signal connector 10, the lower contacts 25 are respectively inserted into the through holes 13 of the printed board 11 and are respectively connected to the lands 14 by soldering on the lower surface 11*a* of the printed board 11. Since the lower contacts 25 are soldered on the lower surface 11*a* of the printed board 11, the soldering condition can be easily checked visually when the differential signal connector 10 is mounted on the printed board 11. Herein, a portion, which is inserted into the through hole 13, of each lower contact 25 is called a board connecting portion.

When the cross-sectional shape of the lower contact 25 is square, the diameter of the through hole 13 of the printed board 11 is designed to be at least slightly greater than a diagonal length of the square of the cross section on the lower contact 25. Further, the lands 14 are formed around the through holes 13 and it is necessary to ensure insulation between the adjacent through holes 13. Taking these into account, it is preferable to set an interval of about 0.8 mm between centers of adjacent ones of the through holes 13.

Figure 3A:
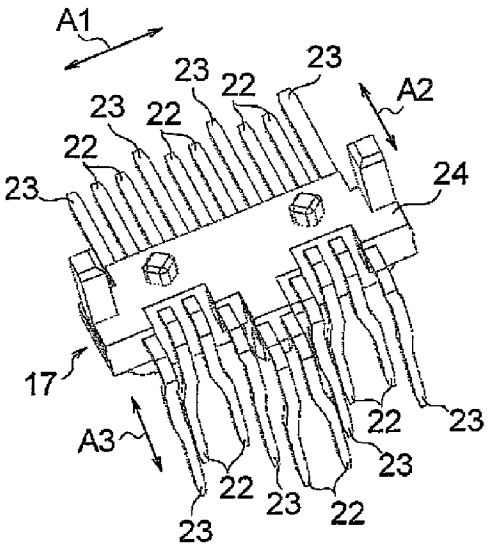
FIG. 3A is a perspective view of a lower contact assembly included in the connector illustrated in FIGS. 2A to 2D.
Figure 3B:
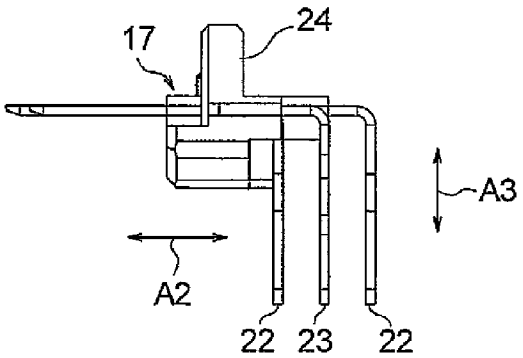
FIG. 3B is a right side view of the lower contact assembly illustrated in FIG. 3A.
Figure 3C:
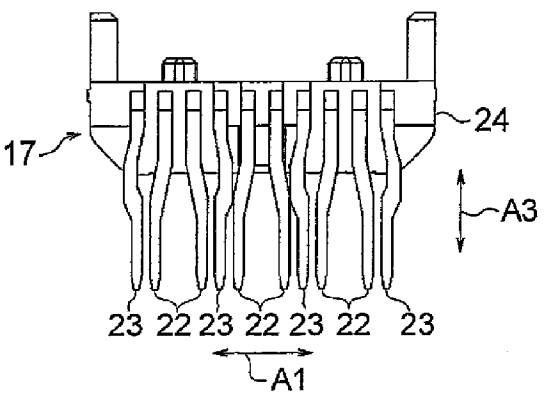
FIG. 3C is a rear view of the lower contact assembly illustrated in FIG. 3A.
Figure 3D:
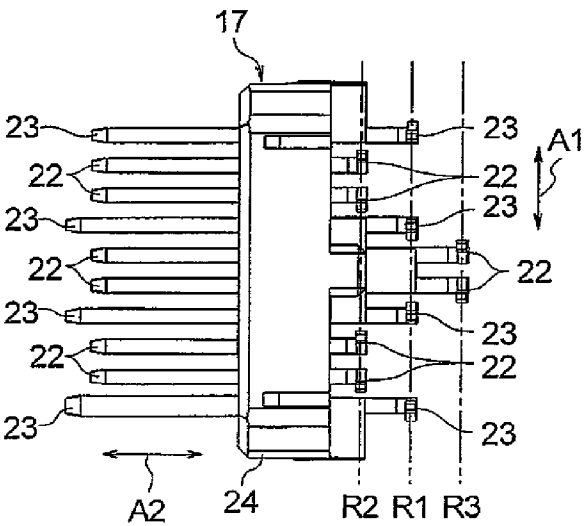
FIG. 3D is a bottom view of the lower contact assembly illustrated in FIG. 3A.

In FIGS. 3A to 3D, the board connecting portions of the lower contacts 25 are arranged in three parallel rows which are parallel to the first direction A1 and which are spaced apart from each other in the second direction A2. Specifically, the board connecting portions of the ground contacts 23 are arranged in a first row R1 so as to be spaced apart from one another. The board connecting portions of the signal contacts 22 are arranged in a second row R2 and a third row R3 which are located on opposite sides of the first row R1. In detail, with respect to every two adjacent pairs of the signal contacts 22 whose connector contacting portions are arranged on opposite sides of each ground contact 23, the board connecting portions of the signal contacts 22 of one pair and those of the other pair are alternately arranged in the second row R2 and the third row R3. As a result, as best shown in FIG. 3D, the board connecting portions of the pairs of signal contacts 22 are arranged zigzag on the opposite sides of the first row R1.

Herein, the signal contacts 22 whose board connecting portions are arranged in the second row R2 are designed to be substantially equal in length to one another while the signal contacts 22 whose board connecting portions are arranged in the third row R3 are designed to be substantially equal in length to one another. That is, the signal contacts 22 whose board connecting portions are arranged in the same row are equal in length to each other. Then, the pairs of signal contacts 22 are allocated to the second row R2 and the third row R3 by the difference in bending from each other, specifically, the difference in bending position from each other, between the first connection side and the second connection side. The ground contacts 23 are arranged in the first row R1 by the difference in bending position from the signal contacts 22 between the first connection side and the second connection side. Instead of providing the difference in bending position, the signal contacts 22 and the ground contacts 23 may be bent at the same position and then arranged in three rows on the second connection side by the difference in number of times of bending (for example, by stepwise bending). Alternatively, the difference in bending position and the difference in number of times of bending may be used in combination.

Further, on the second connection side, each pair of signal contacts 22 are arranged in correspondence to a position between adjacent ones of the ground contacts 23 and the pitch of the signal contacts 22 in each pair is designed to be slightly greater than the pitch of the contact array. As a consequence, on the second connection side, an interval between the signal contacts 22 in each pair is increased so as to assure sufficient electrical insulation.

On the second connection side, each of the ground contacts 23 is arranged in correspondence to a position between every adjacent pairs of signal contacts 22. On the second connection side, each ground contact 23 and the two signal contacts 22, whose contact connecting portions are adjacently arranged on opposite sides of each ground contact 23 on the first connection side, are arranged in a direction obliquely intersecting the first, the second, and the third rows R1, R2, and R3. As a consequence, on the second connection side, an interval between each of the signal contacts 22 and the ground contact 23 is increased so as to assure sufficient electrical insulation.

It will readily be understood that the through holes 13 of the printed board 11 are formed at positions corresponding to the above-mentioned arrangement of the signal contacts 22 and the ground contacts 23 on the second connection side.

Figure 4:
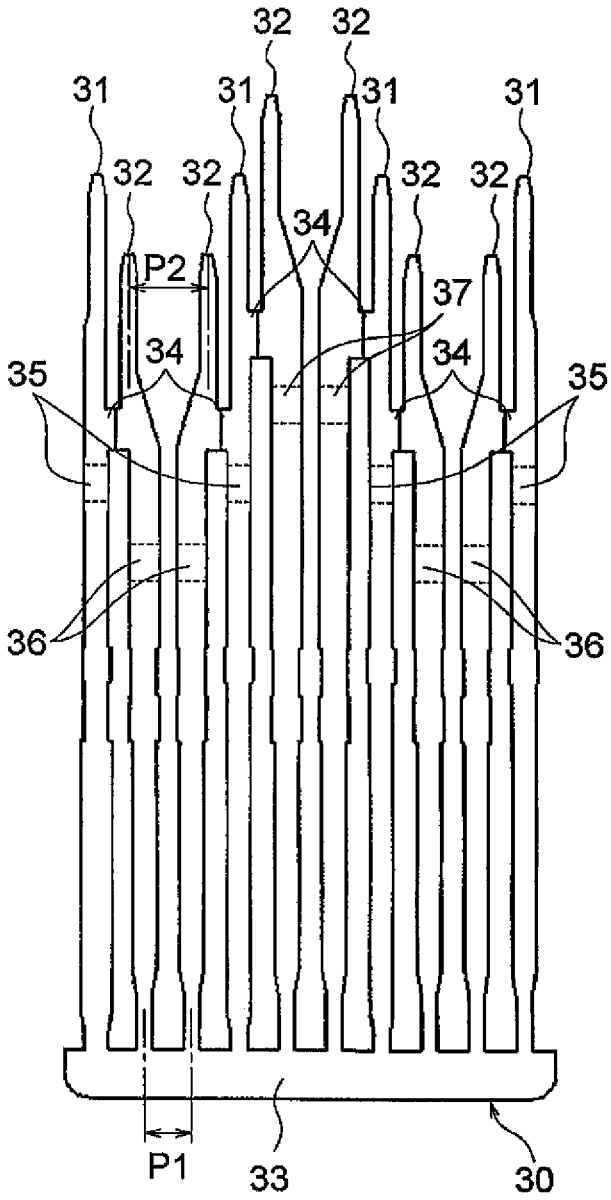
FIG. 4 is a plan view showing one example of a lead frame as an intermediate member for manufacturing a contact group included in the connector illustrated in FIGS. 2A to 2D.

The above-mentioned contact group comprising a combination of the three pairs of conductive signal contacts 22 and the four conductive ground contacts 23 can be easily manufactured by using a lead frame 30 illustrated in FIG. 4 as an intermediate member.

The lead frame 30 illustrated in FIG. 4 is a conductive plate formed by punching a metal plate. The lead frame 30 comprises a plurality of first leads 31 arranged in a plane (along a drawing sheet in the figure) and spaced from one another, a plurality of second leads 32 arranged so as to form pairs each between adjacent ones of the first leads 31, and a connecting portion 33 connecting the first leads 31 and the second leads 32 on one end side. The second leads 32 in each pair have a pitch P1 on one end side and a pitch P2 on the other end side, i.e., on a free end side. When punching the metal plate, the second leads 32 are configured so that the pitch P2 is greater than the pitch P1. With this configuration, the second leads 32 approach the first leads 31 on the free end side. Furthermore, the lead frame 30 has bridge portions 34 connecting every adjacent ones of the first and the second leads 31 and 32 at a position where an interval therebetween is relatively reduced or smallest.

Each of the first leads 31 has an intended bending portion 35, located between the connecting portion 33 and the bridge portion 34, for bending in a direction intersecting the above-mentioned plane. The second leads 32 include short leads each having a shorter length from the connecting portion 33 than that of the first leads 31 and long leads each having a longer length from the connecting portion 33 than that of the first leads 31. The short leads and the long leads have intended bending portions 36 and 37, respectively, located between the connecting portion 33 and the bridge portions 34, for bending in the direction perpendicular to the above-mentioned plane. As compared with the intended bending portion 35 of the first lead 31, the intended bending portion 36 of the short lead is located at a short distance from the connecting portion 33 and the intended bending portion 37 of the long lead is located at a long distance from the connecting portion 33.

The lead frame 30 of the above-mentioned shape can easily be formed by pressing from a single conductor plate even if the interval between the leads is relatively small. Therefore, although the lead frame 30 is formed from the single metal plate, it is possible to reduce the pitch of the contact group.

Next referring to FIGS. 5A to 5D, description will be made of a method of manufacturing the connector group from the lead frame 30 illustrated in FIG. 4.

Figure 5C:
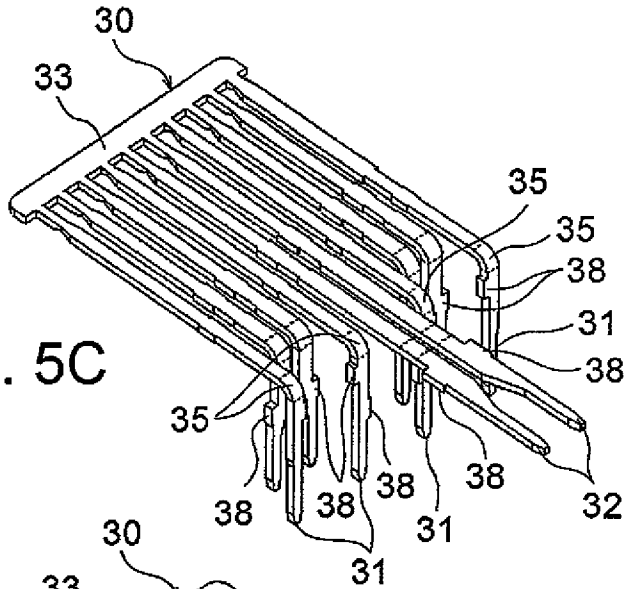
FIGS. 5A to 5D are views for describing a method of manufacturing the contact group from the lead frame illustrated in FIG. 4.
Figure 5D:
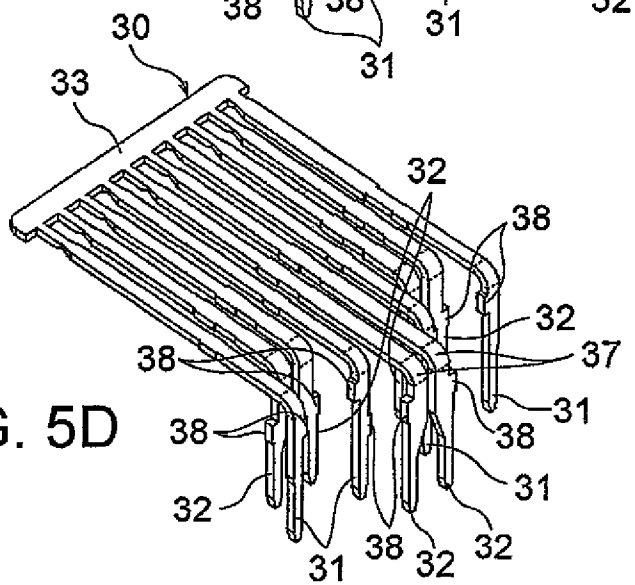
Figure 5A:
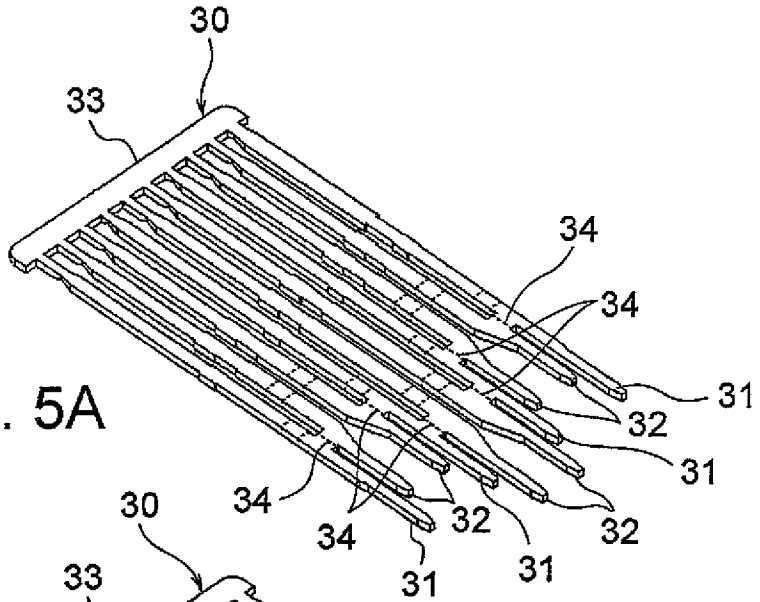

FIG. 5A is a perspective view of the lead frame 30 illustrated in FIG. 4. In the state illustrated in the figure, every adjacent ones of the first and the second leads 31 and 32 are connected to each other by the bridge portion 34.

At first, the bridge portions 34 of the lead frame 30 are cut by shearing to separate the first leads 31 and the second leads 32 from each other.

Since no cutting margin is required in shear cutting, it is possible to cut the bridge portion 34 formed in a narrow area between the first and the second leads 31 and 32 and, after the first and the second leads 31 and 32 are separated, no gap is formed therebetween. Then, simultaneously with separation or after separation, the intended bending portion 36 of each short lead is bent by pressing, as shown in FIG. 5B.

Next, as illustrated in FIG. 5C, the intended bending portion 35 of the first lead 31 is bent by pressing.

Thereafter, as illustrated in FIG. 5D, the intended bending portion 37 of the long lead is bent by pressing.

Figure 5B:
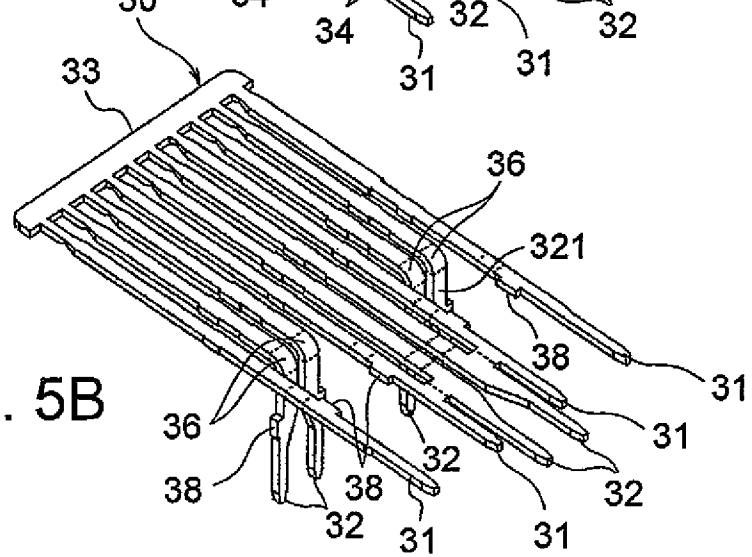

As will be understood from FIGS. 5B to 5D showing the state after bending, a part of the bridge portion 34 cut by shearing is left on each lead as a small protrusion 38. However, the protrusions 38 are spaced from one another in the second direction A2 and do not inhibit electrical insulation.

After the lead frame 30 is formed into a predetermined shape by shear cutting and pressing, the lower housing 24 (see FIGS. 3A to 3D) is integrally formed, for example, by insert molding.

Thereafter, the connecting portion 33 of the lead frame 30 is separated from the first and the second leads 31 and 32. Thus, the lower contact assembly 17 is obtained which has the contact group comprising the three pairs of signal contacts 22 and the four ground contacts 23 and held by the lower housing 24.

The small protrusion 38 formed on each lead is left on each of the signal contacts 22 and the ground contacts 23. For convenience of illustration, these small protrusions 38 are omitted and the shape of each of the signal contacts 22 and the ground contacts 23 is schematically shown in FIGS. 3A to 3D.

Figure 6:
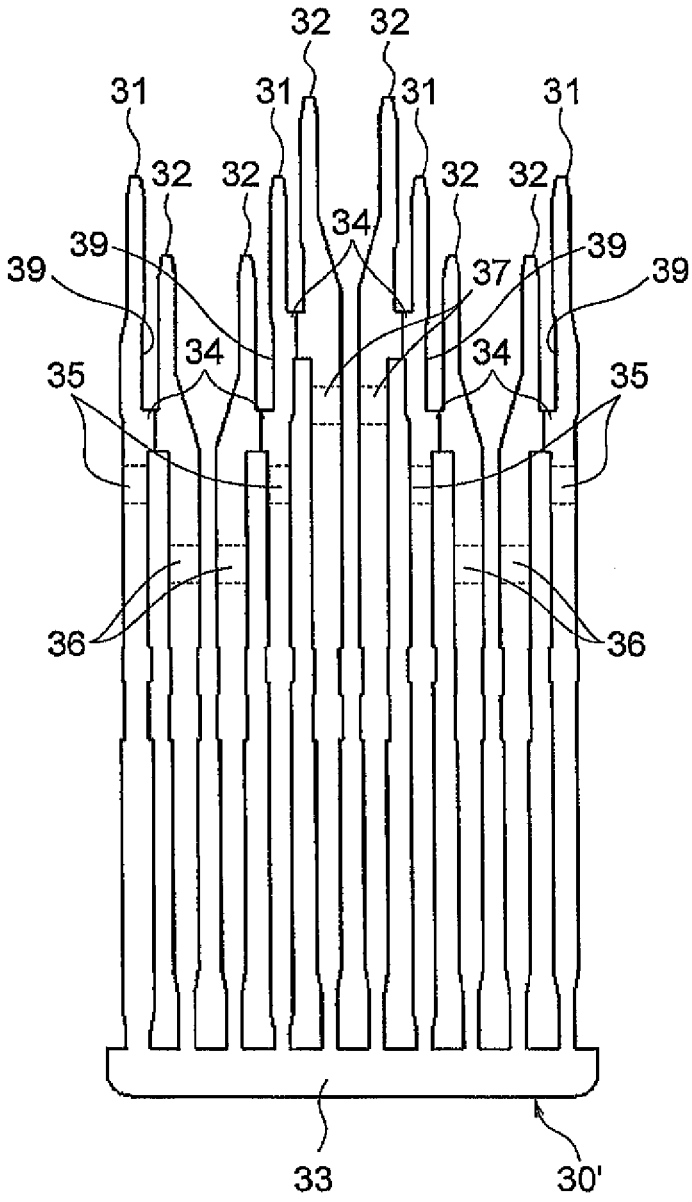
FIG. 6 is a plan view of another example of the lead frame as the intermediate member for manufacturing the contact group included in the connector illustrated in FIGS. 2A to 2D.

As the intermediate member for manufacturing the above-mentioned contact group, a lead frame 3' illustrated in FIG. 6 may be used. Similar parts are designated by the same reference numerals and description thereof will be omitted.

In the lead frame 30' in FIG. 6, the first lead 31 is provided with an escape portion 39 which is formed on a surface faced to the second lead 32 in an area nearer to the free end side than the bridge portion 34 and at a part adjacent to the bridge portion 34 and which is away from the second lead 32. As a result, since the interval between the first and the second leads 31 and 32 is increased at the part where the escape portion 39 is provided, the formation of the lead frame 30' by pressing is facilitated.

A method of manufacturing the connector group from the lead frame 30' in FIG. 6 is similar to the method described in connection with FIGS. 5A to 5D. It will readily be understood that a connector comprising the connector group is substantially similar in structure to the connector illustrated in FIGS. 2A to 2D.

While the invention has been particularly shown and described with reference to the exemplary embodiment thereof, the invention is not limited to these embodiments.

What is claimed is:

1. A lead frame for use as an intermediate member for manufacturing a contact group of a connector, comprising:

a plurality of first leads arranged on a plane and spaced from one another;

a plurality of pairs of second leads, each pair being arranged on the plane between the first leads; and a connecting portion connecting the first and the second leads on one end side, wherein the second leads have a pitch which is greater on the other end side than that on the one end side to make the second leads approach the first leads on the other end side, respectively, and wherein the lead frame further comprises bridge portions connecting approached ones of the first and the second leads to each other at a portion where an interval between the first and the second leads is reduced.

2. The lead frame according to claim 1, wherein each of the first leads and each of the second leads include intended bending portions, located between the connecting portion and the bridge, for bending in a direction intersecting the plane, the intended bending portions of the first and the second leads are located at different distances from the connecting portion from each other.

3. The lead frame according to claim 2, wherein the pairs of second leads comprise a pair of short leads and a pair of long leads, the distance from the connecting portion to the intended bending portion is shorter in the short leads than in the first leads and is longer in the long leads than in the first leads.

4. The lead frame according to claim 3, wherein the short leads are formed so that the length from the connecting portion is shorter than that of the first leads while the long leads are formed so that the length from the connecting portion is longer than that of the first leads.

5. The lead frame according to claim 1, wherein each of the first lead includes an escape portion which is formed on a surface faced to the second leads in an area nearer to the other end side than the bridge portions and at a part adjacent to the bridge portions and which is away from the second lead.

6. A method of manufacturing a contact group, comprising:

preparing the lead frame according to claim 1;

cutting the bridge portions of the lead frame by shearing; and bending the first and the second leads in a direction intersecting the plane.

7. A contact group manufactured by using the lead frame according to claim 1 as an intermediate member.

8. The contact group according to claim 7, wherein, simultaneously when or after the bridge portions are cut by shearing, the first and the second leads are bent at positions different from each other in a direction intersecting the plane.

9. A connector comprising a contact group using as an intermediate member the lead frame according to claim 1, wherein the first and the second leads being bent at positions different from each other in a direction intersecting the plane simultaneously when or after the bridge portions is cut by shearing, the connecting portion being cut away from the first and the second leads.

10. The connector according to claim 9, wherein each of the first leads are used as a ground contact while each of the second lead is used as a signal contact.

* * * * *